US010601139B1

(12) United States Patent
Jablon et al.

(10) Patent No.: US 10,601,139 B1
(45) Date of Patent: Mar. 24, 2020

(54) CONTRAWOUND HELICAL ANTENNA APPARATUS AND METHOD

(71) Applicant: The Johns Hopkins University, Baltimore, MD (US)

(72) Inventors: Allan R. Jablon, Ellicott City, MD (US); Gerald F. Ricciardi, Mount Airy, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 16/387,635

(22) Filed: Apr. 18, 2019

Related U.S. Application Data

(62) Division of application No. 15/355,557, filed on Nov. 18, 2016, now Pat. No. 10,312,595.

(60) Provisional application No. 62/279,848, filed on Jan. 18, 2016.

(51) Int. Cl.

| | |
|---|---|
| ***H01Q 11/08*** | (2006.01) |
| ***H01Q 21/24*** | (2006.01) |
| ***H01Q 1/48*** | (2006.01) |
| ***H01Q 3/24*** | (2006.01) |
| ***H01Q 1/24*** | (2006.01) |

(52) U.S. Cl.
CPC ..... *H01Q 11/083* (2013.01); *H01Q 1/24* (2013.01); *H01Q 1/48* (2013.01); *H01Q 3/247* (2013.01); *H01Q 11/08* (2013.01); *H01Q 21/245* (2013.01)

(58) Field of Classification Search
CPC ..... H01Q 1/48; H01Q 3/24; H01Q 3/247; H01Q 11/08; H01Q 11/083; H01Q 21/24; H01Q 21/245
See application file for complete search history.

(56) References Cited

U.S. PATENT DOCUMENTS

| | | | |
|---|---|---|---|
| 3,184,747 | A | 5/1965 | Kach |
| 5,444,455 | A | 8/1995 | Louzir et al. |
| 5,734,353 | A | 3/1998 | Van Voorhies |
| 6,133,891 | A | 10/2000 | Josypenko |
| 8,681,070 | B2 | 3/2014 | DiNallo et al. |
| 2008/0094307 | A1 | 4/2008 | Cowles |

*Primary Examiner* — Robert Karacsony
(74) *Attorney, Agent, or Firm* — Noah J. Hayward

(57) ABSTRACT

Example apparatuses and methods relating to antennas are provided. An example apparatus in the form of an antenna assembly includes a first conductor formed into a first helical structure wound around a central axis and a second conductor formed into a second helical structure wound around the central axis. The first helical structure may have a first coil sense and the second helical structure may have second coil sense that is opposite the first coil sense. The first conductor may have a first conductor proximal end and a first conductor distal end and the second conductor may have a second conductor proximal end and a second conductor distal end. The first conductor distal end may be adjacent the second conductor proximal end. The antenna assembly may further include first, second, and third ground planes with one disposed at each end of the conductors and one disposed between the conductors.

9 Claims, 10 Drawing Sheets

CONTRAWOUND HELICAL ANTENNA APPARATUS AND METHOD

CROSS-REFERENCE TO RELATED APPLICATIONS

This application is a divisional of prior-filed, co-pending U.S. Nonprovisional application Ser. No. 15/355,557 filed on Nov. 18, 2016, which claims priority to and the benefit of U.S. Provisional Application No. 62/279,848 filed on Jan. 18, 2016, the entire contents of each of which are hereby incorporated herein by reference.

STATEMENT OF GOVERNMENTAL INTEREST

This invention was made with government support under contract number N00024-03-D-6606 awarded by the Naval Sea Systems Command (NAVSEA). The government has certain rights in the invention.

TECHNICAL FIELD

Exemplary embodiments described herein generally relate to antenna technology, and more specifically relate to antenna technologies associated with a helical antenna structures.

BACKGROUND

Wireless communications have become a common-place necessity for interacting in business and personal settings. The revolution associated with the internet of things (IOT) continues to push the evolution of wireless technologies to connect virtually all electronic devices. While wireless solutions have been developed to meet user's needs, there is a continual desire for physically smaller and more flexible wireless devices. One component of a wireless communications device that adds to the device's size is the antenna.

BRIEF SUMMARY

Example apparatuses and methods relating to contrawound helical technology are provided. According to one example embodiment, an example antenna assembly is provided. The example antenna assembly may comprise a first conductor formed into a first helical structure wound around a central axis and a second conductor formed into a second helical structure wound around the central axis. The first helical structure may have a first coil sense and the second helical structure may have a second coil sense that is opposite the first coil sense. The first conductor may have a first conductor proximal end and a first conductor distal end, and the second conductor may have a second conductor proximal end and a second conductor distal end. The first conductor distal end may be adjacent the second conductor proximal end. The antenna assembly may further comprise a first ground plane disposed adjacent to the first conductor proximal end, a second ground plane disposed adjacent to the first conductor distal end and adjacent to the second conductor proximal end, and a third ground plane disposed adjacent the second conductor distal end.

According to another example embodiment, an example communications device is provided. The example communications device may comprise a processor, a transceiver, a switching network, and an antenna assembly. In this regard, the transceiver may be operably coupled to the processor and configured to send data to the processor or receive data from the processor. The switching network may be operably coupled to the processor and the transceiver, and the antenna assembly may be operably coupled to the switching network. The antenna assembly may comprise a first conductor formed into a first helical structure wound around a central axis and a second conductor formed into a second helical structure wound around the central axis. The first helical structure may have a first coil sense and the second helical structure may have a second coil sense that is opposite the first coil sense. Further, the processor may be configured to operate the switching network to cause the switching network to control a direction and a polarization of an antenna beam of the antenna assembly.

According to another example embodiment, an example method is provided. The example method may comprise configuring a switching network by a processor based on configuration instructions and activating a first ground plane, a second ground plane, or a third ground plane based on the switching network configuration. The example method may further comprise transmitting a feed signal to or receiving an inbound signal from a first conductor or a second conductor. In this regard, the first conductor may have a first helical structure wound around a central axis, and the first helical structure may have a first coil sense. Further, the first conductor may have a first conductor proximal end and a first conductor distal end. Additionally, the second conductor may have a second helical structure wound around the central axis, and the second helical structure may have a second coil sense. Further, the second conductor may have a second conductor proximal end and a second conductor distal end. The first conductor distal end may be adjacent the second conductor proximal end, and the first coil sense may be opposite the second coil sense. The example method may further comprise forming an antenna beam from the first conductor and the second conductor. The antenna beam may comprise a left hand circularly polarized beam from the first conductor, a right hand circularly polarized beam from the second conductor, or both a left hand circularly polarized beam from the first conductor and a right hand circularly polarized beam from the second conductor.

BRIEF DESCRIPTION OF THE SEVERAL VIEWS OF THE DRAWINGS

Figure 1A:
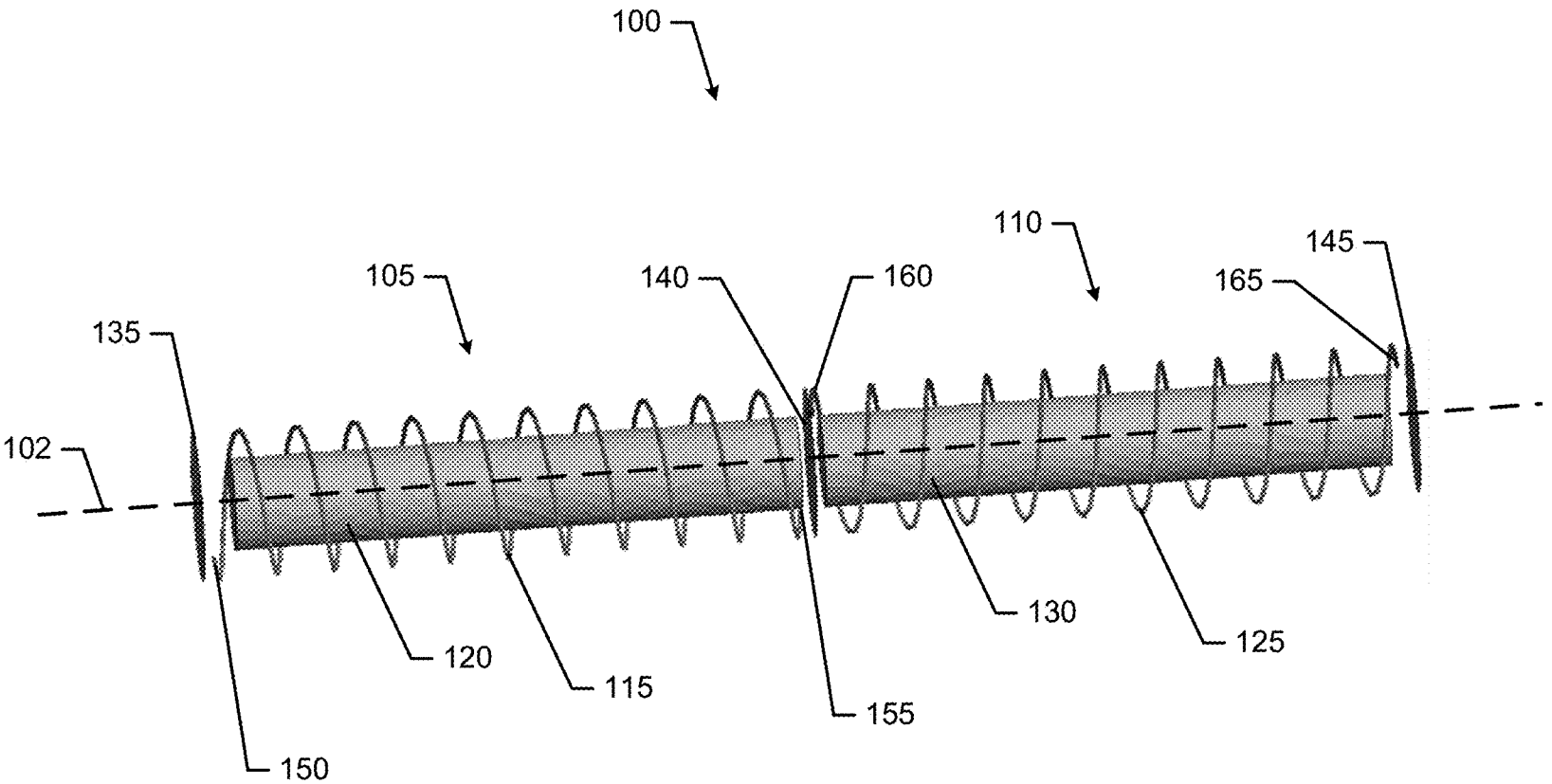
Figure 1B:
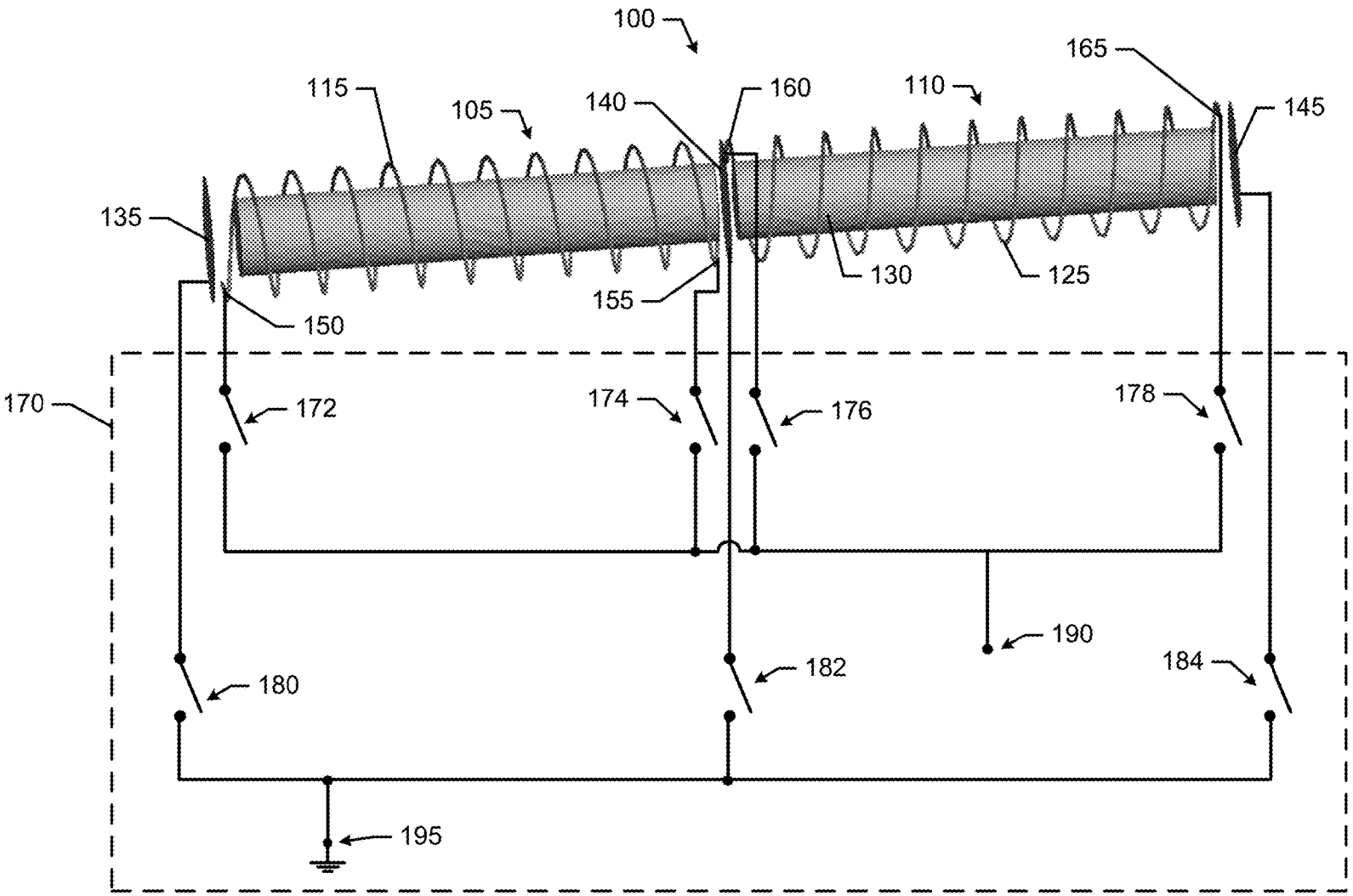
Figure 2A:
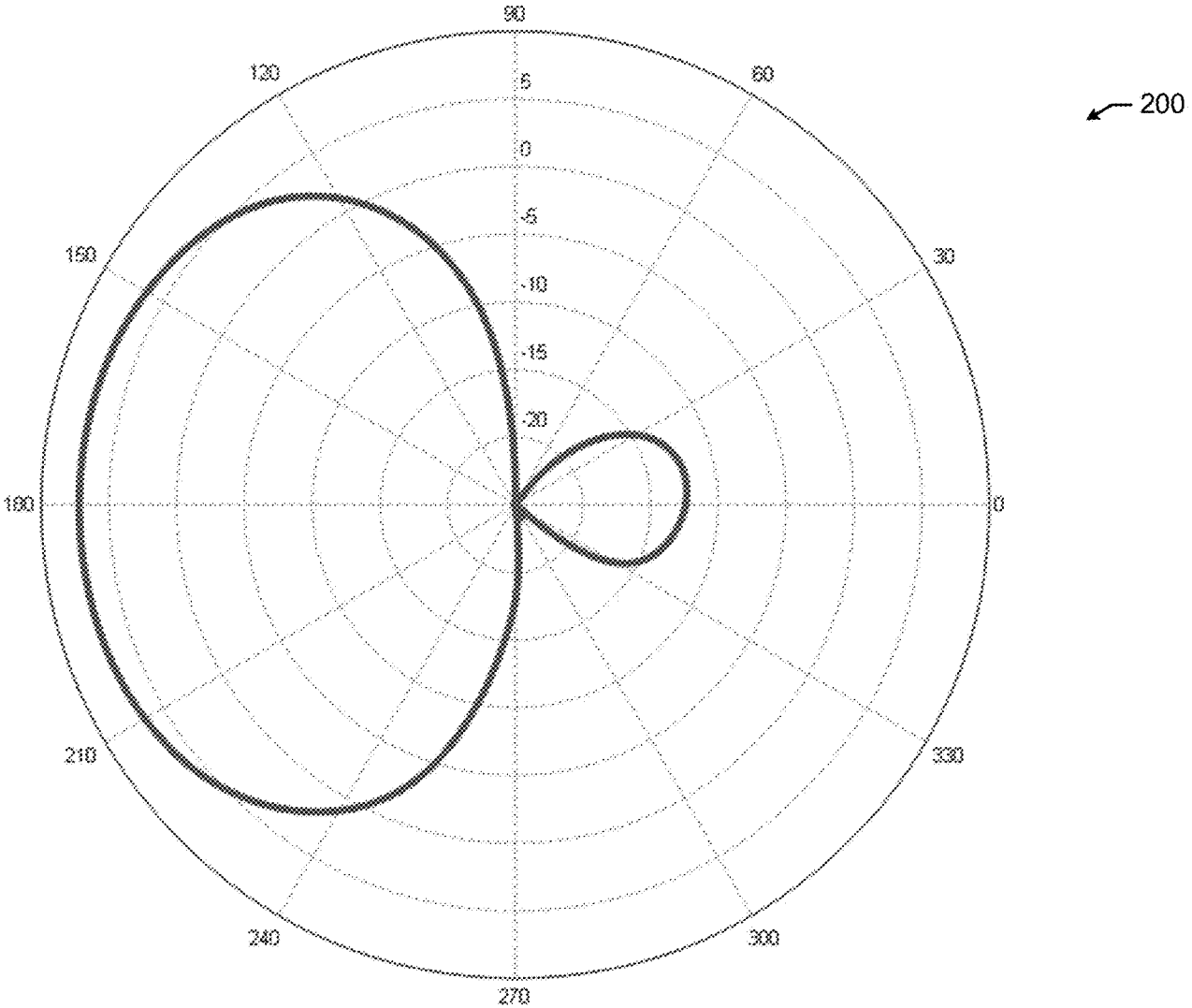
Figure 2B:
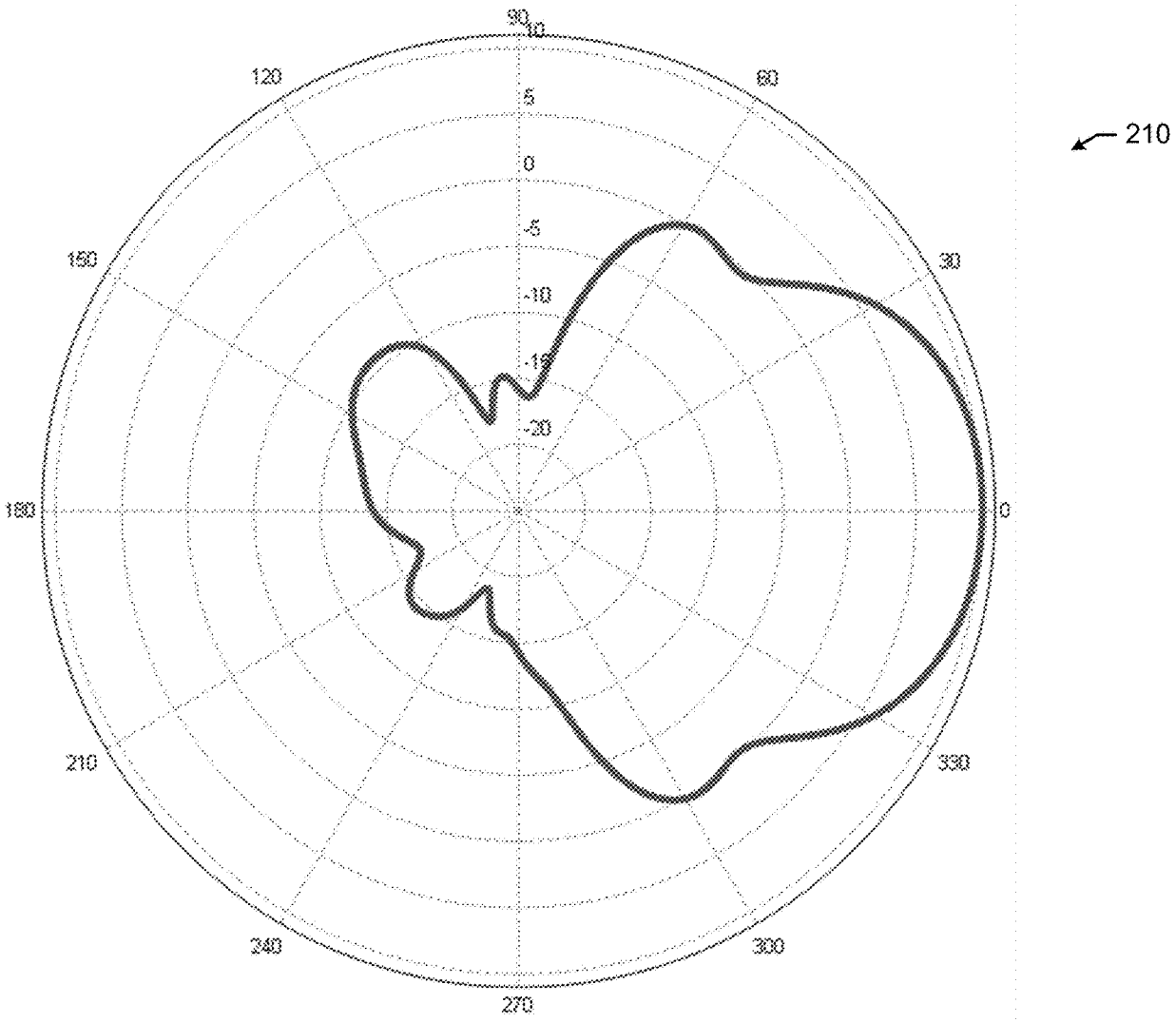
Figure 2C:
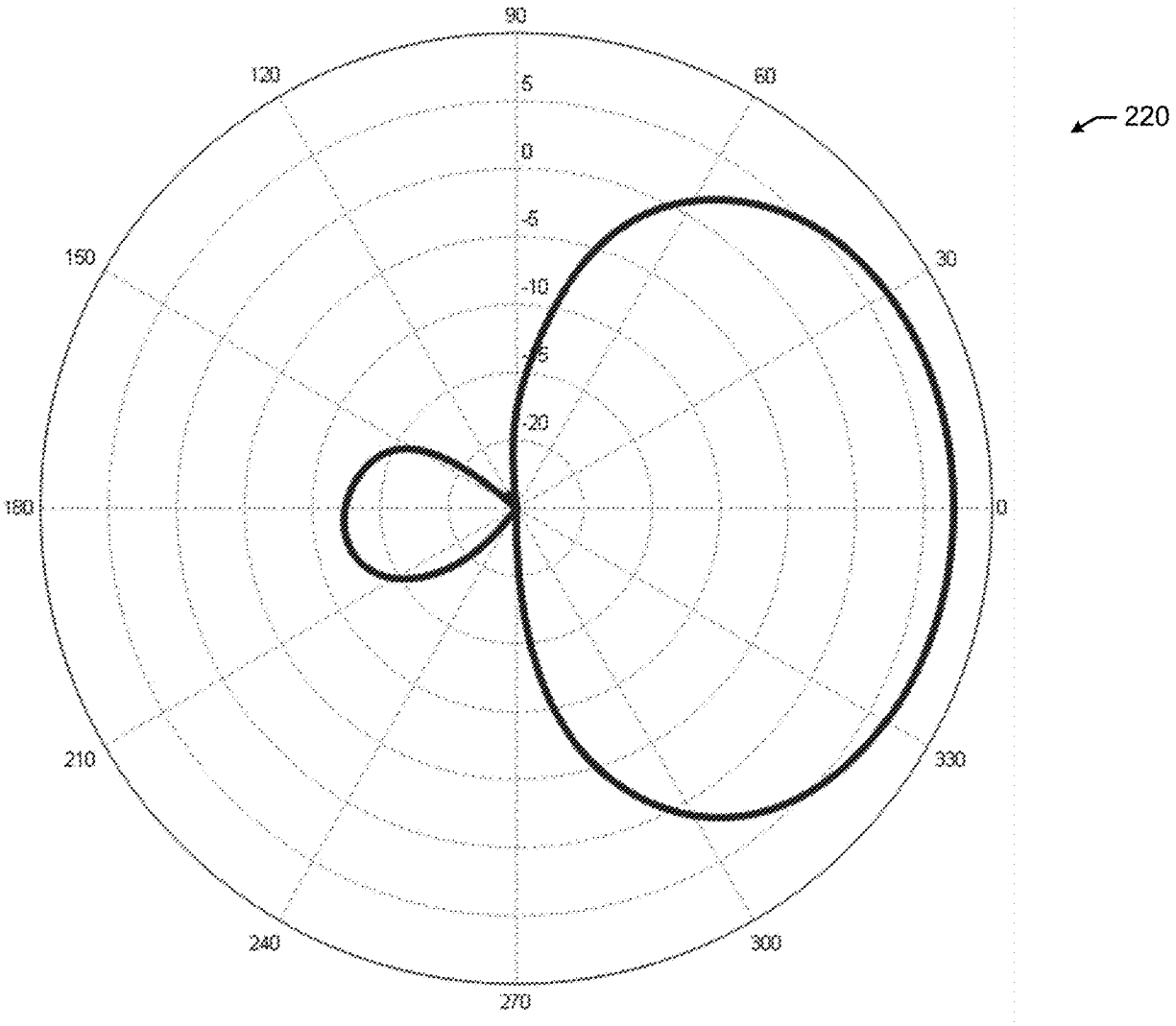
Figure 2D:
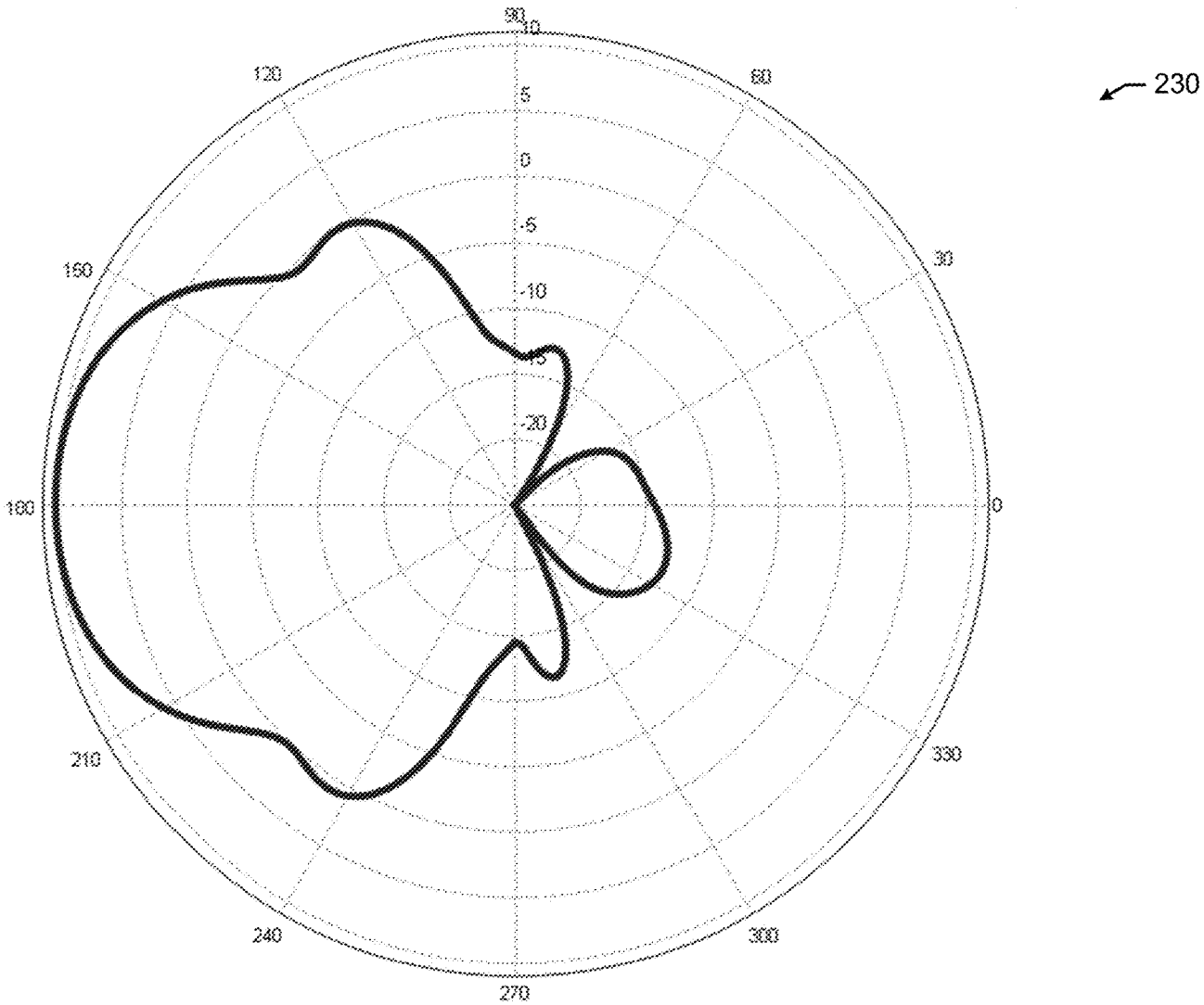
Figure 2E:
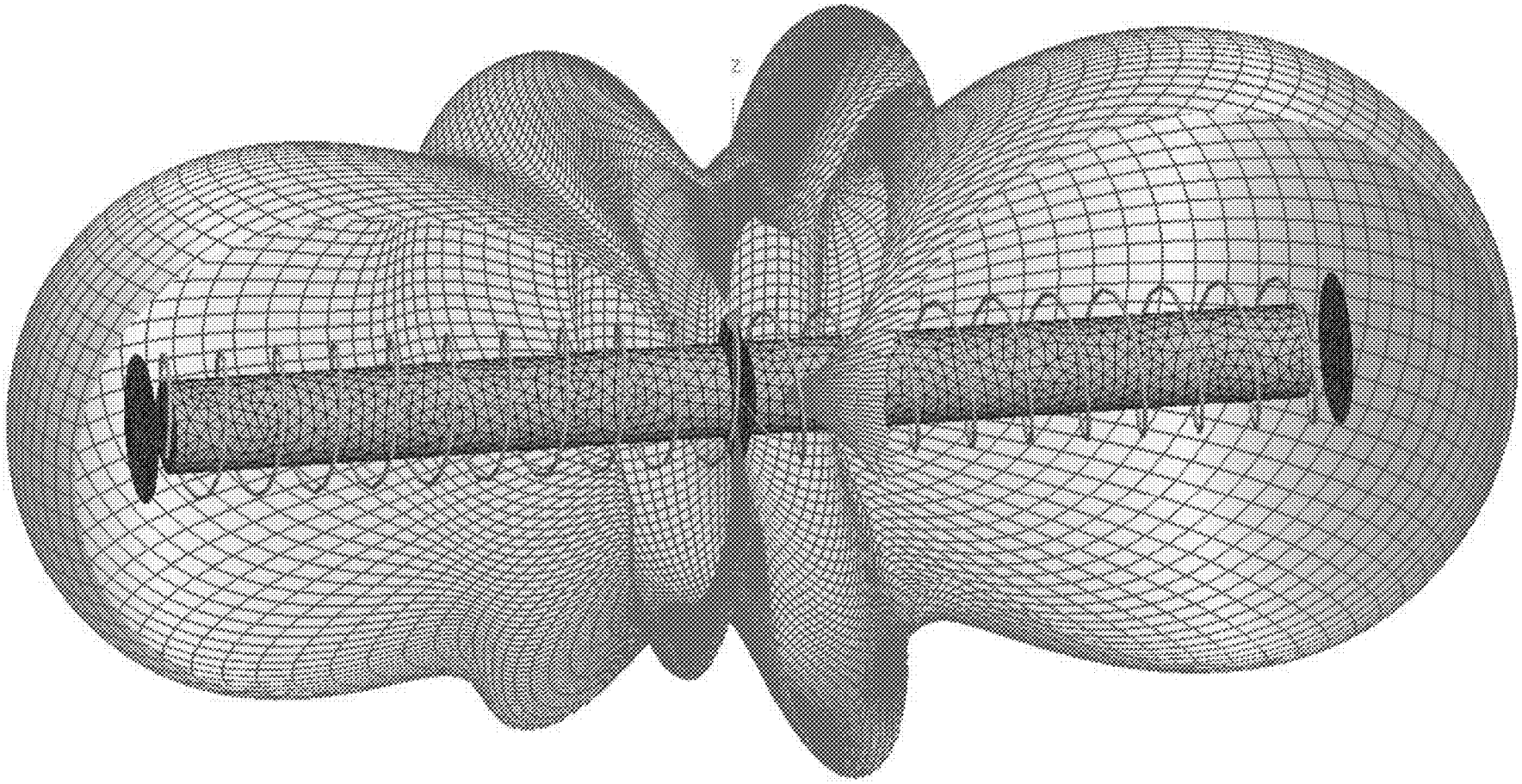
Figure 3:
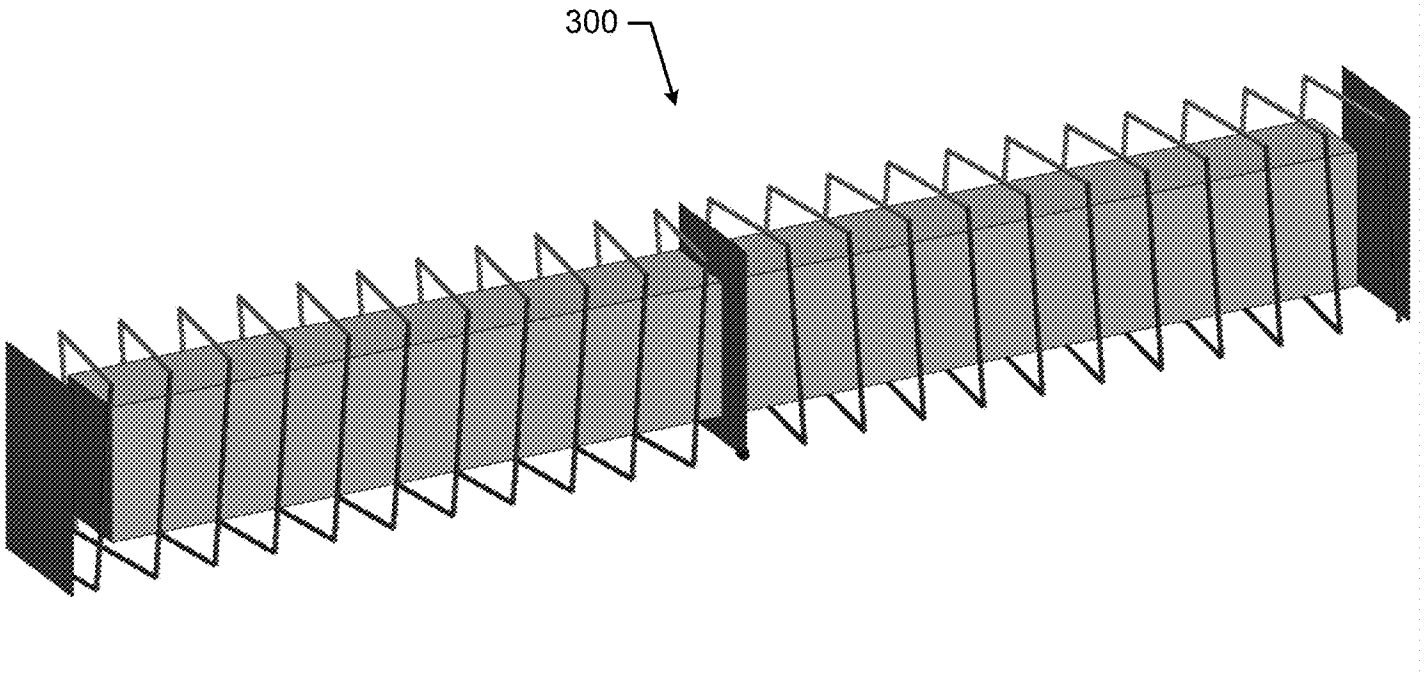
Figure 4:
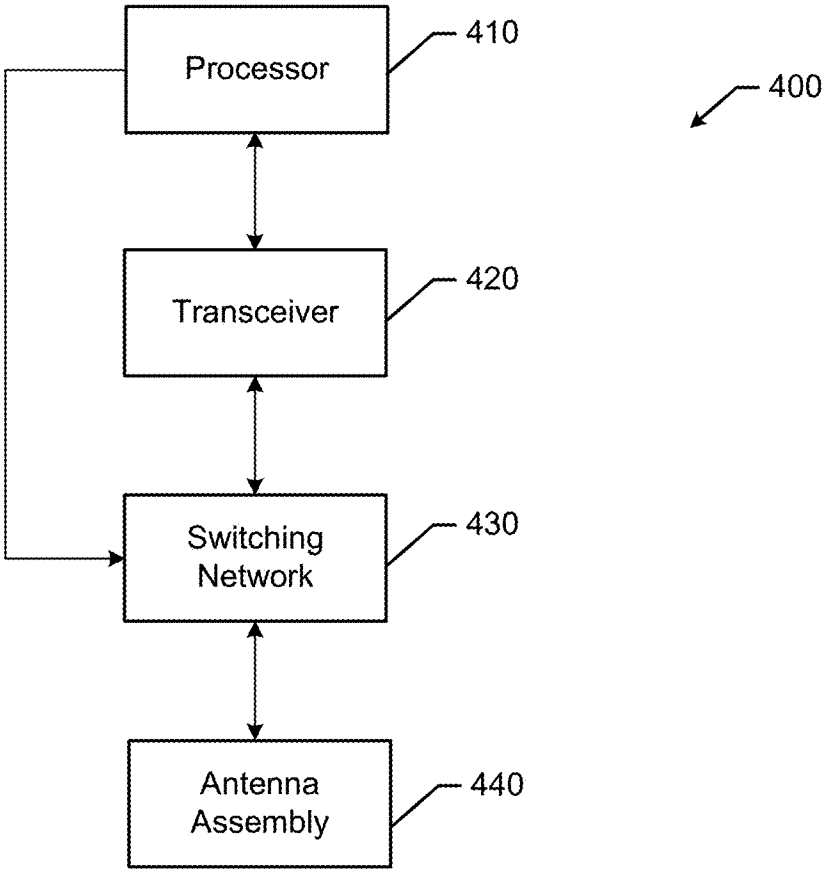
Figure 5:
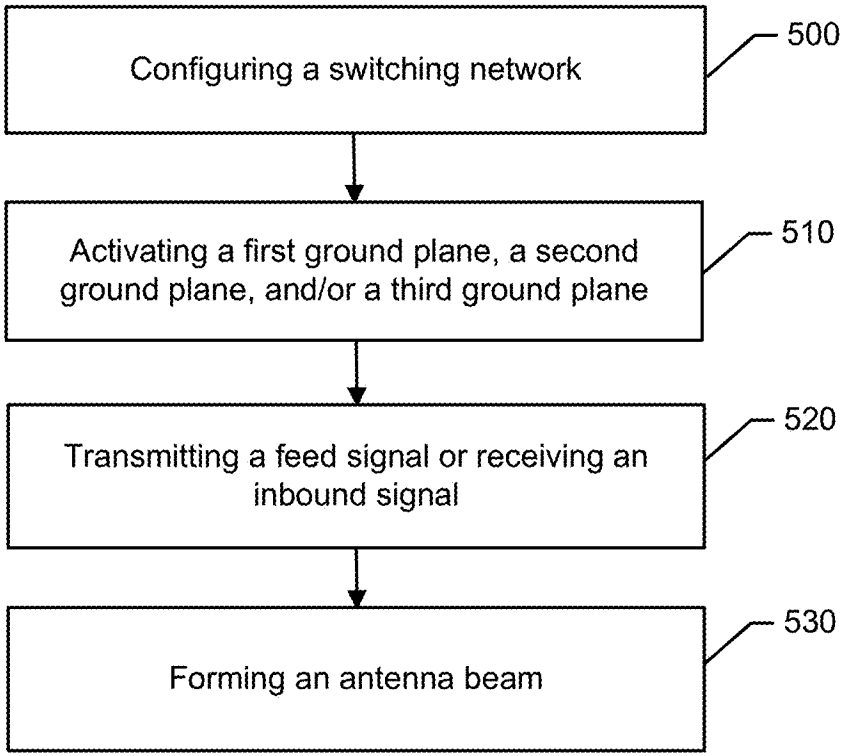

Having thus described some example embodiments in general terms, reference will now be made to the accompanying drawings, which are not necessarily drawn to scale, and wherein:

FIG. 1A illustrates an antenna assembly according to some example embodiments;

FIG. 1B illustrates the antenna assembly of FIG. 1A operably coupled to an example switching network according to some example embodiments;

FIGS. 2A to 2D illustrate polar charts associated with various operational configurations according to some example embodiments;

FIG. 2E is a three dimensional rendering of an antenna beam where two helical structures are contributing to the antenna beam according to some example embodiments;

FIG. 3 illustrates an alternative antenna assembly according to some example embodiments;

FIG. 4 is a block diagram of a communications device according to some example embodiments; and FIG. 5 is a flow chart of an example method according to some example embodiments.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability, or configuration. Rather, these example embodiments are provided to satisfy applicable legal requirements. Like reference numerals refer to like elements throughout. As used herein, the term "or" is used in the logical sense such that any one operand or all operands being a true state provides a result of a true state.

The example embodiments described herein relate to antenna technology, and in particular configurations of helical antennas. According to some example embodiments, a bi-directional contrawound helix antenna design is provided. In this regard, some example embodiments provide and antenna assembly having two helical antenna structures that have coils wound in opposite directions (e.g., one coil being would clockwise and one coil being wound counterclockwise). The helical antenna structures may be placed end-to-end with ground planes disposed on each end and in between the helical antenna structures. Using this example antenna assembly, different feed points and ground planes can be selectively utilized, via a switching network, to generate desired antenna beams (e.g., output radiation) from the single antenna assembly. As such, the single antenna assembly can be leveraged for various and disparate applications and can be configured to support the various and disparate applications through control of the feed points and ground planes. Example antenna assemblies described herein may provide a reduction in the size of an antenna, while supporting operation of the antenna over a broad range of frequencies with flexible beam direction and circular polarization (e.g., left hand vs. right hand circular polarization). Example embodiments of the antenna assemblies described herein can operate in various bands including, for example, the ultra-high frequency (UHF) band. However, the radiating structure can be made to operate at higher or lower frequencies by way of simple geometric scaling (e.g., halving its size in all dimensions allows the structure to work at exactly twice the frequency range).

FIG. 1A illustrates an example antenna assembly 100 according to some example embodiments. The antenna assembly 100, having a lengthwise form factor, may include a first helical structure 105 and a second helical structure 110. Each of the first helical structure 105 and the second helical structure 110 may be monofilar helical antennas operating in the axial mode such that the structures can be configured to form an end fire antenna beam. The gain of the antenna assembly 100 may be a function of the first and second helical structures' volume and length. In this regard, the gain of the antenna assembly 100 may be adjusted by increasing the length of the first and second helical structures to obtain, for example, relatively medium gain, approximately 10 to 20 dBi. Further, the antenna assembly 100 may have a relatively broad bandwidth of operation (e.g., at least 30%). The gain of the structure is driven by the length of the helical structure, not by the aperture area formed by the circular cross section—due to the fact that the helices are traveling wave structures operating in an end fire mode as opposed to that of a typical aperture antenna. In this regard, some example embodiments advance the state of the art given that two oppositely wound helices with ground planes can be collocated in a single package and allow individual control of beam direction (fore and aft) with selectable circular polarization via a new excitation (feed) arrangement.

With respect to the first helical structure 105, the structure may include a first conductor 115 that is comprised of a conductive material, such as, for example, a metal material. The first conductor 115 may be wound into a helical structure about a center axis 102 to have, for example, a first coil sense that is, for example, circularly wound (to produce, for example, a right hand circularly polarized beam or left hand circularly polarized beam). The winding may be circular. However, one of skill in the art would appreciate that structures other than a circle may be utilized such as, for example, a square, rectangle, ellipse, or the like. Further, from a given reference point (e.g., the first conductor proximal end 150) the first conductor 115 may wound in either a clockwise direction or a counterclockwise direction. The direction of winding may be referred to the conductor's coil sense, and a conductor that is wound in clockwise direction, as viewed from a reference point, has an opposite coil sense relative to a conductor that is wound in a counterclockwise direction, as viewed from the same reference point.

The first conductor 115 may have two ends—a first conductor proximal end 150 and a first conductor distal end 155. According to various example embodiments, the first conductor proximal end 150 or the first conductor distal end 155 may be utilized as selectable feed points for the first helical structure 105 as further described below. Additionally, according to some example embodiments, the first helical structure 105 may include a core 120 (e.g., a cylindrical core) that may be comprised of, for example, a dielectric material or a metal material. According to some example embodiments, the core 120 may be constructed such that an internal cavity is electrically isolated from any electromagnetic field formed by the antenna assembly 100. The core 120 may include a cavity configured to house electronics configured to utilize and drive the antenna assembly 100. Core 120 may allow for protection of the electronics housed in the cavity via, for example, a Faraday cage or other shielding.

With respect to the second helical structure 110, the structure may include a second conductor 125 that is comprised of a conductive material, such as, for example, a metal material. The second conductor 125 may also be wound into a helix structure about the center axis 102. However, the second conductor 125 may be wound such that the second conductor 125 has a second coil sense (e.g., in one embodiment may transmit, for example, a right hand circularly polarized beam) that is opposite the first coil sense (e.g., in one embodiment may transmit, for example, a left hand circularly polarized beam) of the first conductor 115, and is, for example, circularly wound. However, one of skill in the art would appreciate that structures other than a circle may be utilized such as, for example, a square, rectangle, ellipse, or the like. The second conductor 125 may have two ends—a second conductor proximal end 160 and a second conductor distal end 165. According to various example embodiments, the second conductor proximal end 160 or the second conductor distal end 165 may be utilized as selectable feed points for the second helical structure 110 as further described below. Additionally, according to some example embodiments, the second helical structure 110 may include a core 130 (e.g., a cylindrical core) that may be comprised of, for example, a dielectric material or metallic material. According to some example embodiments, the core 130 may be constructed such that an internal cavity is electrically isolated from any electromagnetic field formed by the antenna assembly 100. The core 130 may include a cavity configured to house electronics configured to utilize and drive the antenna assembly 100. Core 130 may allow for protection of the electronics housed in the cavity via, for example, a Faraday cage or other shielding.

According to some example embodiments, the first helical structure 105 and the second helical structure 110 may be disposed such that the structures are positioned and aligned end-to-end along the central axis 102. In this regard, the first conductor distal end 155 may be disposed near the second conductor proximal end 160.

The antenna assembly 100 may further comprise a plurality of ground planes. In this regard, the antenna assembly 100 may include a first ground plane 135, a second ground plane 140, and a third ground plane 145. The first ground plane 135 may be disposed adjacent to the first conductor proximal end 150 such that the central axis 102 passes through the first ground plane 135. The second ground plane 140 may be disposed adjacent to and between the first conductor distal end 155 and the second conductor proximal end 160 such that the central axis 102 passes through the second ground plane 140. Finally, the third ground plane 145 may be disposed adjacent to the second conductor distal end 165 such that the central axis 102 passes through the third ground plane 145. As further described below, the ground planes may be selectively activated based upon a desired beam direction and circular polarization.

Additionally, the ground planes 135, 140, and 145 may have an associated shape, and in some example embodiments, the shapes may be the same or similar. In this regard, according to some example embodiments, each ground plane 135, 140, and 145 may have a shape, respectively, and an associated area of the shape may be the same or similar to an area of a two dimensional cross section taken orthogonal to the of the center axis 102 of the first helical structure 105 and the second helical structure 110. The respective area of each of the ground plane 135, 140, and 145 shapes may be the same or smaller than the area of the two dimensional cross section taken orthogonal to the of the center axis 102 of the first helical structure 105 and the second helical structure 110. Further, according to some example embodiments, the two dimensional cross section taken orthogonal to the of the center axis 102 of the first helical structure 105 and the second helical structure 110 may be a circle having a coil diameter with a given length. As used herein, the coil diameter may also be referred to as the diameter of the associated helical structure (i.e., a first diameter of the first helical structure 105 and a second diameter of the second helical structure 110). In this regard, the ground planes 135, 140, and 145 may also have a circular shape with respective diameters having a length that is substantially the same as the coil diameter, or shorter than the coil diameter, of the first helical structure 105 and the second helical structure 110. Further, according to some example embodiments, the first helical structure 105 and the second helical structure 110 may have a cross sectional shape that is not circular (e.g., elliptical, rectangular, etc.) and therefore a diameter of the cross sectional shape may not be uniform or may be non-constant. According to some example embodiments, the diameter of the cross sectional shape may be approximately the desired wavelength of operation divided by four. Further, with added dielectric loading, power handling, and select dielectric materials for the core, the antenna assembly 100 may be further miniaturized relative to conventional monofilar helical antennas configured for operation at the same wavelength.

Now referring to FIG. 1B, the antenna assembly 100 may be operably coupled to a switching network. The switching network may be configured to receive control signals to activate or deactivate the first ground plane, second ground plane, or third ground plane. The switching network may be further configured to receive a control signal to activate the proper switches to one or more of the proximal end of the first conductor, the distal end of the first conductor, the proximal end of the second conductor, or the distal end of the second conductor, as described above and otherwise herein. An example control signal could be a DC voltage capable of activating the switch via a coiled-based relay.

In this regard, the antenna assembly 100 may be operably coupled to a switching network such as the functional switching network 170. It is understood that components of functional switching network 170 are merely depicting functional representations of switches and that a radio frequency (RF) circuit design would be required to properly implement the antenna assembly 100 for desired frequencies and bandwidth. Such an RF circuit design may include an RF switching network, as well as, for example, RF switches, RF combiners, RF couplers, impedance matching networks, transmission lines, or the like. An RF switching network that can operate in conjunction with the antenna assembly 100 may control end fire direction and polarization of an antenna beam generated via the antenna assembly 100 (for transmitting or receiving based on, for example, the electromagnetic reciprocity theorem). Generally speaking, each of the ends (e.g., 150, 155, 160, and 165) of the first helical structure 105 and the second helical structure 110 may be switchably selected as feed points for a feed signal to be transmitted. The feed signal may be any signal incorporating data that is intended for wireless transmission. Likewise, the ends of the first helical structure 105 and the second helical structure 110 may be switchably selected as receive points for receiving a wireless signal via the antenna assembly 100. In addition to selecting the signal feed points, the functional switching network 170 may also be operated to control or activate the ground planes 135, 140, and 145 in accordance with the selected feed points. When not active in an application, ground planes 135, 140, or 145 may be floating (i.e., not load terminated) to minimize the mutual coupling between the adjacent helices.

More specifically, the functional switching network 170 may include controllable switches that may be implemented in hardware, software, or a combination thereof to drive appropriate signals to control the antenna assembly 100. In this regard, a feed signal may be applied at node 190 and node 195 may be functionally coupled to ground. Accordingly, a feed signal may be applied to the first conductor proximal end 150 by closing functional switch 172, to the first conductor distal end 155 by closing functional switch 174, to the second conductor proximal end 160 by closing functional switch 176, or to the second conductor distal end 165 by closing functional switch 178. Similarly, ground may be coupled to the first ground plane 135 by closing functional switch 180, to the second ground plane 140 by closing functional switch 182, and to the third ground plane 145 by closing functional switch 184.

As mentioned above, a plurality of radiation beams and directivities of the beams may be generated via the functional switching network 170. The following provides example configurations that may be implemented in accordance with various example embodiments. It is understood that in each configuration, each functional switch is open (thereby creating a floating node), unless the configuration indicates that the particular functional switch is closed.

In this regard, in a first configuration, the first ground plane 135 is a source ground to the first helical structure 105 (e.g., by closing functional switch 180). The feed signal may be applied to the first conductor proximal end 150 (e.g., by closing functional switch 172) thereby resulting in a backfire beam directed towards the feed point (i.e., towards the first conductor proximal end 150) having left hand circular polarization. FIG. 2A is a polar plot 200 indicating the direction of the antenna beam with left hand circular polarization generated by the antenna assembly 100 in this first configuration. The antenna assembly 100 can generate a back fired beam towards the signal feed point (i.e., towards the first conductor proximal end 150), which is indicated by the relative high gain (i.e., greater than 5 dBi) at 180 degrees.

In a second configuration, the second ground plane 140 is a source ground to the first helical structure 105 (e.g., by closing functional switch 182. The feed signal may be applied to the first conductor distal end 155 (e.g., by closing functional switch 174) resulting in a backfire beam directed towards the feed point (i.e., towards a first conductor distal end 155) having left hand circular polarization. FIG. 2B is a polar plot 210 indicating the direction of the antenna beam with left hand circular polarization generated by the antenna assembly 100 in this second configuration. The antenna assembly 100 can generate a back fired beam towards the signal feed point (i.e., towards the first conductor distal end 155), which is indicated by the relative high gain (i.e., approximately 10 dBi) at 0 degrees.

In a third configuration, the third ground plane 145 is a source ground to the second helical structure 110 (e.g., by closing functional switch 184). The feed signal may be applied to the second conductor distal end 165 (e.g., by closing functional switch 178) resulting in a backfire beam directed towards the feed point (i.e., towards the second conductor distal end 165) having right hand circular polarization. FIG. 2C is a polar plot 220 indicating the direction of the antenna beam with right hand circular polarization generated by the antenna assembly 100 in this third configuration. The antenna assembly 100 can generate a back fired beam towards the signal feed point (i.e., towards the second conductor distal end 165), which is indicated by the relative high gain (i.e., greater than 5 dBi) at 0 degrees.

In a fourth configuration, the second ground plane 140 is a source ground to the second helical structure 110 (e.g., by closing functional switch 182). The feed signal may be applied to the second conductor proximal end 160 (e.g., by closing functional switch 176) resulting in a backfire beam directed towards the feed point (i.e., towards the second conductor proximal end 160) having right hand circular polarization. FIG. 2D is a polar plot 230 indicating the direction of the antenna beam with right hand circular polarization generated by the antenna assembly 100 in this third configuration. The antenna assembly 100 can generate a back fired beam towards the signal feed point (i.e., towards the second conductor distal end 165), which is indicated by the relative high gain (i.e., approximately 10 dBi) at 180 degrees.

The four configurations described above are described as operating in an isolated fashion leveraging a single helical structure. However, according to some example embodiments, both helical structures may be operated simultaneously. For example, the first configuration may be combined with the fourth configuration, and since both beams have high gain at 180 degrees, the total gain of the antenna assembly 100 may be increased at 180 degrees with the first helical structure 105 forming a left hand circularly polarized beam and the second helical structure 110 having a right hand circularly polarized beam. Alternatively, the second configuration and the third configuration, and since both beams have high gain at 0 degrees, the total gain of the antenna assembly 100 may be increased at 0 degrees with the first helical structure 105 forming a left hand circularly polarized beam and the second helical structure 110 having a right hand circularly polarized beam. Further, non-correlating options may also be utilized. For example, the first configuration may be combined with the third configuration thereby generating beams that emanate away from the antenna assembly 100 in opposite directions with the first helical structure 105 forming a left hand circularly polarized beam directed towards the first conductor proximal end 150 and the second helical structure 110 having a right hand circularly polarized beam directed towards second conductor distal end 165. To the contrary, the second configuration may be combined with the fourth configuration to thereby generate beams internally directed at each other, which may prove useful in particular applications. In this regard, a beam formed by the first helical structure 105 may form a left hand circularly polarized beam directed towards the second conductor distal end 165 and the beam formed by the second helical structure 110 may form a right hand circularly polarized beam directed towards the first conductor proximal end 150. Accordingly, both right hand circularly polarized and left hand circularly polarized beams may be generated, either one at a time in either direction or simultaneously. Thus, polarization may be operator selectable. In this regard, FIG. 2E illustrates an example three-dimensional beam diagram of a scenario where both the first helical structure 105 and the second helical structure 110 are simultaneously contributing to the formation of an antenna beam for the antenna assembly 100.

FIG. 3 illustrates an alternative antenna assembly 300 that has a rectangular cross section. Conceptually, the antenna assembly 300 may be configured to operate in the same or similar manner to antenna assembly 100 as described herein. According to some example embodiments, radio electronics (e.g., a processor, a transceiver, a switching network, or the like) may more readily be disposed within the rectangular core of the antenna assembly 300 due to the package size of components and construction of printed circuit boards that may be utilized.

FIG. 4 illustrates a block diagram of a wireless communications device 400 that may utilize an antenna assembly as described herein. In this regard, the wireless communications device 700 may include a processor 410, a transceiver 420, a switching network 430, and an antenna assembly 440. The processor may be a general purpose processing device that is configured via software to direct the transceiver 420 and the switching network 430 to drive the antenna assembly 440 to, for example, wirelessly communicate with other devices to support a given application. According to some example embodiments, the processor 410 may be hardware configured as an FPGA (field programmable gate array) or an ASIC (application specific integrated circuit) to direct the transceiver 420 and the switching network 430 to drive the antenna assembly 440 to, for example, wirelessly communicate with other devices to support a given application. The processor 410 may be configured through a variety of options ranging from push button switches (manually) to software control (integrated as part of a larger system). A control signal from the processor to the transceiver 420 and/or switching network 430 may be provided via either a wired or wireless link. The transceiver 420 may be an electronic device, similarly configured in software or hardware, to support wireless communications with other wireless communications devices by driving the antenna assembly 440 to wirelessly transmit data, or monitor antenna assembly 440 to receive data, via the switching network 430. In this regard, transceiver 420 may operate to transform data provided by the processor 410 for transmission via the antenna assembly 440, and the switching network 430. Alternatively, transceiver 420 may operate to transform data received by the antenna assembly 440 and provide the transformed data to the processor 410 for analysis. In this regard, according to some example embodiments, the transceiver may be a radio transmitter, a radio receiver, or both.

According to some example embodiments, the processor 410 may be configured to operate the switching network 430 and thereby generate a desired antenna beam pattern from the antenna assembly 440, as described above. Accordingly, switching network 430 may be configured to control a direction and polarization of an antenna beam of the antenna assembly 440 based upon which of the first, second, or third ground planes are activated and which of the ends of the conductors are provided the feed signal, as described above.

According to various example embodiments, the antenna assembly 440 may be constructed as, for example, the antenna assemblies 100 and 300 described above. In this regard, according to some example embodiments, the antenna assembly 440 may comprise a first conductor formed into a first helical structure wound around a central axis and a second conductor formed into a second helical structure wound around the central axis. The first helical structure may have a first coil sense and the second helical structure may have a second coil sense that is opposite the first coil sense. The first conductor may have a first conductor proximal end and a first conductor distal end, and the second conductor may have a second conductor proximal end and a second conductor distal end. The first conductor distal end may be adjacent the second conductor proximal end. The antenna assembly 440 may further comprise a first ground plane disposed adjacent to the first conductor proximal end, a second ground plane disposed adjacent to the first conductor distal end and adjacent to the second conductor proximal end, and a third ground plane disposed adjacent the second conductor distal end.

According to some example embodiments, the first helical structure of the antenna assembly 400 may have a first diameter, and the second helical structure may have a second diameter. Further, a length of the first diameter may be substantially the same as a length of the second diameter. According to some example embodiments, the length of the first diameter and the second diameter may be non-constant. Additionally or alternatively, the first helical structure of the antenna assembly 440 may have a two-dimension cross-sectional area on a plane orthogonal to the central axis, and the second helical structure have a two-dimension cross-sectional area on a plane orthogonal to the central axis, and the two-dimension cross-sectional area of the first helical structure may be substantially the same as the two-dimension cross-sectional area of the second helical structure. Further, the area of each of the first ground plane, the second ground plane, and the third ground plane may be substantially the same or smaller than the two-dimension cross-sectional area of the first helical structure or the second helical structure. According to some example embodiments, the first conductor and the second conductor of the antenna assembly 440 may operate in an axial mode in conjunction with the first, second, and third ground planes. The switching network may be further configured to receive control signals from the processor to activate or deactivate the first ground plane, second ground plane, or third ground plane. The antenna assembly 440 may further include a core, where the first helical structure and the second helical structure are wound around the core. Further, the core may comprise a dielectric material or metallic material. According to some example embodiments, the processor, transceiver, and switching network may be housed in the core.

FIG. 5 is a flowchart for providing an antenna assembly according to some example embodiments. It will be understood that each block of the flowchart, and combinations of blocks in the flowchart, may be implemented by various means, such as by hardware or by hand. In this regard, using an antenna assembly according to some example embodiments is shown in FIG. 5. This example technique may comprise configuring a switching network by a processor based on configuration instructions at 500. In this regard, the configuration instructions may be received by a processor configured to control the switching network. Configuration instructions may be any type of control signal that can be interpreted and used to control the switching network, and thereby cause formation of an antenna beam having a desired direction and polarization. The processor may receive the configuration instructions from, for example, a memory device or from a received wireless communication. The example method may further include activating a first ground plane, a second ground plane, and/or a third ground plane based on the switching network configuration at 510. Further, at 520, the example method may include transmitting a feed signal to or receiving an inbound signal from a first conductor or a second conductor. The feed signal may be provided to the transceiver by, for example, by the processor. The inbound signal may be received from at least one of the first and second conductors, and may have originated as a wireless signal. The feed signal may be transmitted (e.g., from the transceiver) to or the inbound signal may be received from a first conductor having a first helical structure wound around a central axis. The first helical structure may have a first coil sense. The first conductor may have a first conductor proximal end and a first conductor distal end. Alternatively, or additionally, the feed signal may be transmitted to or the inbound signal may be received from a second conductor having a second helical structure wound around the central axis. The second helical structure may have a second coil sense, where the first coil sense is opposite the first coil sense. The second conductor may have a second conductor proximal end and a second conductor distal end. The first conductor distal end may be adjacent the second conductor proximal end. The example method may further comprise, at 530, forming an antenna beam from the first conductor and the second conductor. In this regard, the antenna beam may include a left hand circularly polarized beam from the first conductor, a right hand circularly polarized beam from the second conductor, or both a left hand circularly polarized beam from the first conductor and a right hand circularly polarized beam from the second conductor. According to some example embodiments, the switching network may be configured to control a direction and a polarity of the antenna beam based upon which of the first, second, and/or third ground planes are activated and which of the ends of the conductors are utilized as one or more feed points.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A communications device comprising:

a processor;

a transceiver operably coupled to the processor and configured to send data to the processor or receive data from the processor;

a switching network operably coupled to the processor and the transceiver; and an antenna assembly, the antenna assembly being operably coupled to the switching network;

wherein the antenna assembly comprises:

a first conductor formed into a first helical structure wound around a central axis, the first helical structure having a first coil sense, a first conductor proximal end, and a first conductor distal end;

a second conductor formed into a second helical structure wound around the central axis, the second helical structure having a second coil sense opposite the first coil sense, a second conductor proximal end, and a second conductor distal end, wherein the first conductor distal end is adjacent the second conductor proximal end;

a first ground plane disposed adjacent to the first conductor proximal end;

a second ground plane disposed adjacent to the first conductor distal end and adjacent to the second conductor proximal end; and a third ground plane disposed adjacent the second conductor distal end, wherein the processor is configured to operate the switching network to cause the switching network to control a direction and a polarization of an antenna beam of the antenna assembly.

2. The communications device of claim 1, wherein the first helical structure has a first diameter and the second helical structure has a second diameter; and wherein a length of the first diameter is substantially the same as a length of the second diameter.

3. The communications device of claim 1, wherein the first helical structure has a two-dimension cross-sectional area on a plane orthogonal to the central axis and the second helical structure has a two-dimension cross-sectional area on a plane orthogonal to the central axis;

wherein the two-dimension cross-sectional area of the first helical structure is substantially the same as the two-dimension cross-sectional area of the second helical structure;

wherein an area of the first ground plane is substantially the same or smaller than the two-dimension cross-sectional area of the first helical structure;

wherein an area of the second ground plane is substantially the same or smaller than the two-dimension cross-sectional area of the first helical structure; and wherein an area of the third ground plane is substantially the same or smaller than the two-dimension cross-sectional area of the first helical structure.

4. The communications device of claim 1, wherein the switching network activates the first, second, or third ground planes and provides a feed signal to the first conductor proximal end, the first conductor distal end, the second conductor proximal end, or the second conductor distal end.

5. The communications device of claim 1, wherein the first conductor and the second conductor operate in an axial mode in conjunction with the first, second, and third ground planes.

6. The communications device of claim 1, wherein the switching network is further configured to receive control signals from the processor to activate or deactivate the first ground plane, second ground plane, or third ground plane.

7. The communications device of claim 1, wherein the switching network is further configured to control a direction and polarization of an antenna beam of the antenna assembly based upon which of the first, second, or third ground planes are activated and which of the ends of the conductors are provided the feed signal.

8. The communications device of claim 1, further comprising a core, the first helical structure and the second helical structure being wound around the core, the core comprising a dielectric material; and wherein the processor, transceiver, and switching network are housed in the core.

9. The communications device of claim 1, wherein the first helical structure has a first diameter; and wherein a length of the first diameter is non-constant.

* * * * *